US010365056B2

(12) United States Patent
McCormick

(10) Patent No.: US 10,365,056 B2
(45) Date of Patent: Jul. 30, 2019

(54) MAGAZINE FOLLOWER FOR ENHANCING RELIABILITY OF FIREARMS AND FIREARM MAGAZINES

(71) Applicant: Michael L. McCormick, Austin, TX (US)

(72) Inventor: Michael L. McCormick, Austin, TX (US)

(73) Assignee: Wilson's Gun Shop, Inc., Berryville, AR (US)

( * ) Notice: Subject to any disclaimer, the term of this patent is extended or adjusted under 35 U.S.C. 154(b) by 0 days.

(21) Appl. No.: 15/435,079

(22) Filed: Feb. 16, 2017

(65) Prior Publication Data

US 2017/0241726 A1 Aug. 24, 2017

Related U.S. Application Data

(60) Provisional application No. 62/296,912, filed on Feb. 18, 2016.

(51) Int. Cl.
*F41A 9/70* (2006.01)

(52) U.S. Cl.
CPC ..... *F41A 9/70* (2013.01)

(58) Field of Classification Search
CPC ..... F41A 9/65; F41A 9/67; F41A 9/69; F41A 9/70
USPC ..... 42/50, 49.1
See application file for complete search history.

(56) References Cited

U.S. PATENT DOCUMENTS

| | | | | |
|---|---|---|---|---|
| 1,833,862 A | | 11/1931 | Schmeisser | |
| 1,878,039 A | | 9/1932 | Von Frommer | |
| 2,296,729 A | * | 9/1942 | Mossberg | F41A 9/71 42/49.02 |
| 2,870,561 A | | 1/1959 | Colby | |
| 3,222,810 A | | 12/1965 | Musgrave | |
| 3,399,480 A | | 9/1968 | Rowe, Jr. | |
| 3,453,762 A | | 7/1969 | Fremont | |
| 3,516,189 A | | 6/1970 | Lewis et al. | |

(Continued)

FOREIGN PATENT DOCUMENTS

| | | |
|---|---|---|
| DE | 418191 C | 8/1925 |
| DE | 601941 C | 8/1934 |

(Continued)

*Primary Examiner* — John Cooper
(74) *Attorney, Agent, or Firm* — Foley & Lardner LLP

(57) ABSTRACT

A magazine for a firearm is formed by a magazine box with a spring therein. A magazine follower in the magazine box is urged toward an open end thereof by the spring, and is formed by a base member extending along a longitudinal axis of the magazine box, and slide stop actuating and cartridge engaging structures extending outwardly from the base member. The slide stop actuating and/or the cartridge engaging structures are resiliently biased in a lateral direction away from a longitudinal axis of the base member to be movable between: (1) a compressed position wherein a longitudinal axis of the slide stop and/or the cartridge engaging structures are laterally perpendicular with the longitudinal axis of the base member, and (2) an uncompressed position where the longitudinal axis of the slide stop actuating and/or the cartridge engaging structures are not laterally perpendicular with the longitudinal axis of the base member.

19 Claims, 4 Drawing Sheets

(56) References Cited

U.S. PATENT DOCUMENTS

| | | | | |
|---|---|---|---|---|
| 3,711,981 | A * | 1/1973 | Seecamp | F41A 9/69 42/50 |
| 3,732,643 | A | 5/1973 | Wells | |
| 3,854,232 | A | 12/1974 | Musgrave | |
| 4,446,645 | A * | 5/1984 | Kelsey, Jr. | F41A 9/70 42/50 |
| 4,825,744 | A | 5/1989 | Glock | |
| 4,970,818 | A | 11/1990 | Vecchieschi | |
| 5,014,456 | A * | 5/1991 | Kurtz | F41A 9/65 42/50 |
| 5,168,648 | A | 12/1992 | Brandl et al. | |
| 5,438,783 | A | 8/1995 | Sniezak et al. | |
| 5,615,505 | A * | 4/1997 | Vaid | F41A 9/61 42/18 |
| 6,560,907 | B1 * | 5/2003 | Vieweg | F41A 9/70 42/50 |
| 6,952,894 | B1 * | 10/2005 | Vieweg | F41A 9/65 42/50 |
| 7,200,963 | B1 * | 4/2007 | Vieweg | F41A 9/65 42/49.01 |
| 7,318,294 | B2 | 1/2008 | Zimmermann | |
| 8,650,787 | B2 * | 2/2014 | McCormick | F41A 17/36 42/18 |
| 9,170,062 | B2 * | 10/2015 | Corso | F41A 9/65 |
| 9,772,153 | B1 * | 9/2017 | Findlay | F41A 9/73 |
| 10,183,361 | B2 * | 1/2019 | McCormick | F41A 9/66 |
| 2010/0101132 | A1 | 4/2010 | Jacobson | |
| 2010/0281737 | A1 | 11/2010 | Cahill | |
| 2011/0173856 | A1 * | 7/2011 | McCormick | F41A 9/65 42/50 |
| 2012/0124879 | A1 | 5/2012 | Larue | |
| 2012/0167428 | A1 | 7/2012 | Watermann et al. | |
| 2013/0086834 | A1 | 4/2013 | Battaglia | |
| 2017/0205169 | A1 * | 7/2017 | Parker | F41A 9/67 |
| 2018/0010872 | A1 * | 1/2018 | Parker | F41A 9/67 |

FOREIGN PATENT DOCUMENTS

| | | | |
|---|---|---|---|
| GB | 875222 | A | 8/1961 |
| WO | WO-2008137187 | A2 | 11/2008 |

* cited by examiner

MAGAZINE FOLLOWER FOR ENHANCING RELIABILITY OF FIREARMS AND FIREARM MAGAZINES

PRIORITY CLAIM

This application is a non-provisional claiming priority to U.S. App. No. 62/296,912 filed Feb. 18, 2016, entitled Magazine Follower for Enhancing Reliability of Firearms and Firearm Magazines, the disclosure of which is incorporated by reference in its entirety.

TECHNICAL FIELD

Disclosed herein is a magazine follower and magazine for use in a firearm. In particular, the magazine follower and magazine disclosed herein enhance the reliability of firearms by consistently actuating the slide lock mechanism of firearms after a last round in the magazine used by the firearm has been fired, extracted, and ejected.

BACKGROUND

In semiautomatic or automatic firearms, cartridges which are to be fired are commonly stored in a detachable magazine. The magazine defines an enclosure adapted to contain at least one column of cartridges. The cartridges are loaded into the magazine so as to be located atop a magazine follower which engages a lowermost cartridge in the magazine. A magazine spring is included in the magazine and is compressible between the magazine follower and a bottom portion of the magazine so as to bias the follower and loaded cartridges upwardly in the magazine toward an upper open end. An uppermost cartridge from the magazine is loaded into a firing position in the firearm by cooperation with a slide of the firearm.

The slide is adapted to be moveable from an initial firing position rearwardly with respect to the firearm frame, barrel, and magazine and then return forwardly under a spring biasing force. During the returning forward movement of the slide, the slide contacts and strips the uppermost cartridge from the magazine. Under the contact from the slide and the biasing force from the magazine spring, the cartridge moves upwardly with respect to the magazine and forwardly in the firearm, ultimately reaching a firing position in the firing chamber of the firearm.

When a loaded magazine is first placed in the firearm, the slide may be manually cycled to place the first cartridge from the magazine in the firing position. Thereafter, energy from the fired cartridge is used to cycle the slide to eject the casing of the fired cartridge and load the next cartridge from the magazine into the firing chamber. In this manner, each successive shot fired causes the magazine follower and the column of cartridges to incrementally travel upwardly, and each successive cartridge is fed into the firing position in the firearm until no further cartridges remain in the magazine.

A firearm, such as the superlative Model 1911, may be designed so that when the last cartridge from the magazine is fired and the magazine is thus empty, the slide locks open and does not complete its full cycle of movement. This slide locking gives the operator an important visual indication that the magazine is empty. As well, the operator can often tell by feel that the slide has not made its complete cycle to the rear and then back forward. These indications provided by the slide locking in an open position is crucial in a combat, law enforcement, or personal defense setting in which it is not practical for the operator to keep track of the number of cartridges they have fired from a given magazine. The locked open slide informs the operator that the firearm needs to be reloaded.

The slide lock mechanism for locking the slide in the open position when the magazine is empty may include a lever mounted on the firearm frame. This slide lock lever is mounted so that it may move between a locking position in which it catches on a notch or other feature of the slide, and a retracted position in which the slide is free to cycle. The slide lock lever may be biased in some fashion to the retracted position, and, in some firearms, is moved to the locking position by contact with a portion of the magazine follower. In particular, the slide lock lever may include or be connected to a lug which extends through an opening in the firearm frame into the area of the firearm that receives the upper end of the magazine. As the last cartridge is stripped from the magazine, the follower reaches its uppermost position in the magazine under the biasing force of the magazine spring. At this point, contact between a portion of the follower and the slide lock lug forces the slide lock lever toward its extended, locking position. Then, when the last cartridge from the magazine is fired, the slide moves rearwardly under the force of the discharge but is caught in the open position by contact between the slide lock lever and the notch or other locking feature on the slide.

Manufactured items have dimensions subject to tolerances, such that different manufactured items may have different precise dimensions. The tolerances of each constituent component of a magazine, and of the pistol components which interface with the magazine have may significant variations, which in some case result in adverse tolerance stack ups. With pistols which have adverse tolerance stack ups among the components which interface with the magazine assembly, less than a zero tolerance fit between the mag tube and the area of the follower which engages the slide stop can result in a failure to engage the slide stop in order to activate slide lock subsequent to the final round being fired.

The magazine box and follower may also have adverse tolerance stack ups in the side to side fit of the follower to the mag tube. Combining adverse tolerance stack ups with the magazine components and adverse tolerance stack ups with the components of the pistol which interface with the magazine components serves to compound the negative results of adverse tolerances.

Consequently, a new magazine design which provides for reliable operation and dependable slide lock subsequent to the final round being fired, regardless of tolerances, is desirable.

SUMMARY

One aspect of the invention disclosed herein is a magazine follower for a firearm. The magazine follower is formed by a base member, with a slide stop actuating structure extending outwardly from the base member and a cartridge engaging structure extending outwardly from the base member. At least one of the slide stop actuating structure and the cartridge engaging structure are resiliently biased in a lateral direction away from a longitudinal axis of the base member so as to be movable between: (1) a compressed position wherein a longitudinal axis of at least one of the slide stop actuating structure and the cartridge engaging structure is laterally perpendicular with respect to the longitudinal axis of the base member, and (2) an uncompressed position where the longitudinal axis of at least one of the slide stop actuating structure and the cartridge engaging structure is not laterally perpendicular with respect to the longitudinal axis of the base member.

Another aspect of the invention disclosed herein is a magazine incorporating the magazine follower described above. In particular, the magazine is formed from a magazine box with a magazine spring within the magazine box. A magazine follower is within the magazine tube and is urged toward an open end of the magazine box by the magazine spring. The magazine follower is formed from a base member extending along a longitudinal axis of the magazine box, a slide stop actuating structure extending outwardly from the base member, and a cartridge engaging structure extending outwardly from the base member.

At least one of the slide stop actuating structure and the cartridge engaging structure are resiliently biased in a lateral direction away from a longitudinal axis of the base member so as to be movable between: (1) a compressed position wherein a longitudinal axis of at least one of the slide stop actuating structure and the cartridge engaging structure is laterally perpendicular with respect to the longitudinal axis of the base member, and (2) an uncompressed position where the longitudinal axis of at least one of the slide stop actuating structure and the cartridge engaging structure is not laterally perpendicular with respect to the longitudinal axis of the base member.

A method aspect of the invention disclosed herein is a method of making an apparatus. This method includes forming a length of metal into a base member with first and second structures extending outwardly therefrom and then resiliently biasing at least one of the first structure and the second structure in a lateral direction away from a longitudinal axis of the base member so as to be movable between: (1) a compressed position wherein a longitudinal axis of at least one of the first structure and the second structure is laterally perpendicular with respect to the longitudinal axis of the base member, and (2) an uncompressed position where the longitudinal axis of at least one of the first structure and the second structure is not laterally perpendicular with respect to the longitudinal axis of the base member.

The magazine follower may form an interference fit with the interior walls of the magazine in three or more locations.

In addition, the cartridge engaging structure and slide stop actuating structure may be resilient in multiple directions, and may be able to be biased or moved upwardly and downwardly, as well as laterally.

DETAILED DESCRIPTION

Figure 2:
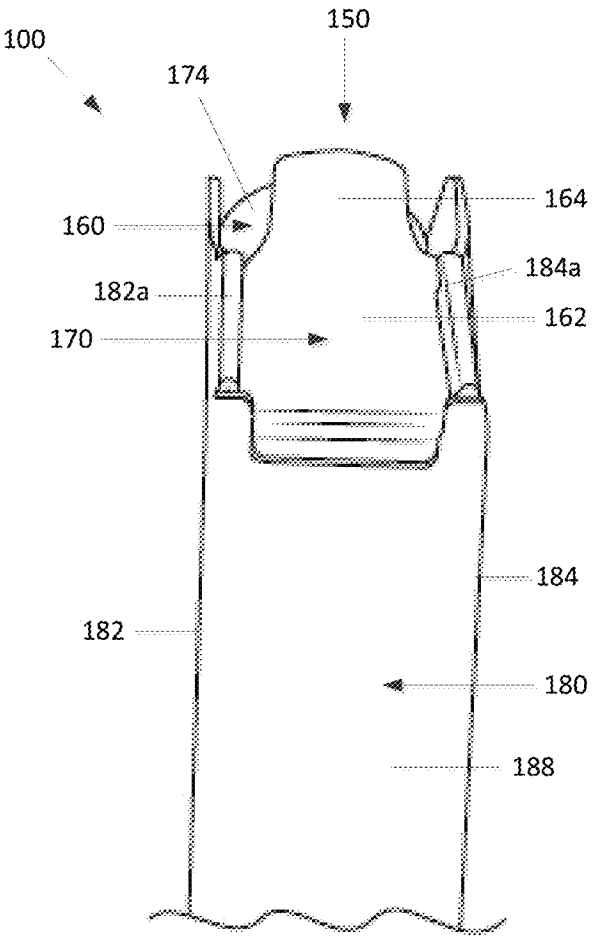
FIG. 2 is a rear isometric view of the magazine.
Figure 1:
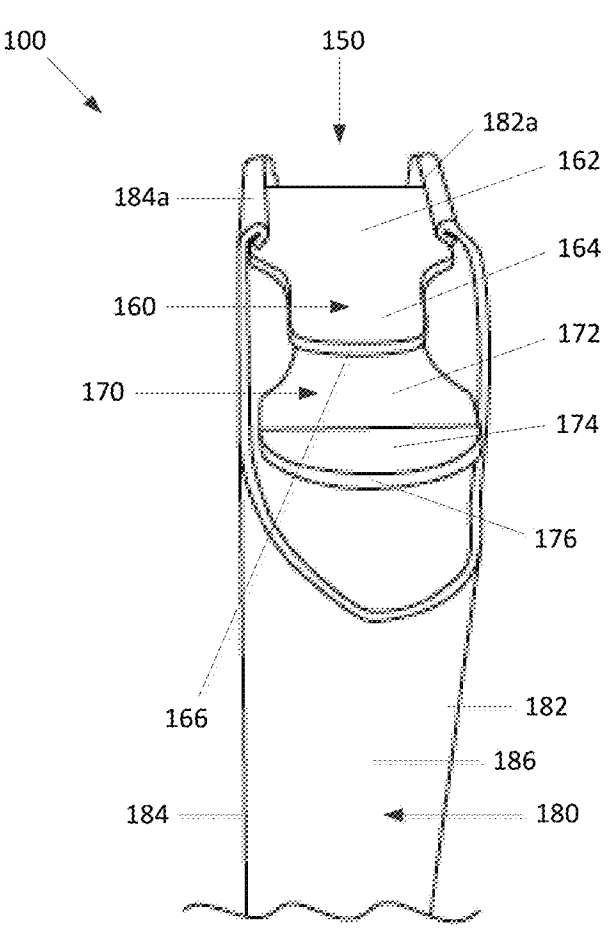
FIG. 1 is a front isometric view of a magazine for a firearm, as disclosed herein.
Figure 3:
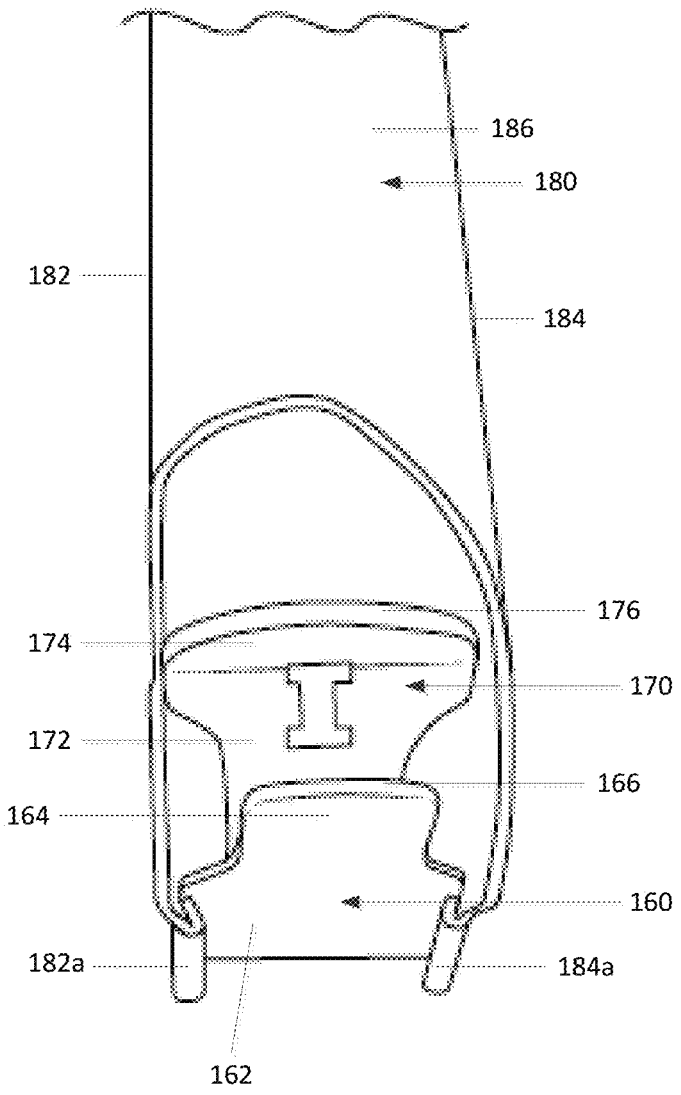
FIG. 3 is another front isometric view of the magazine.

In the following detailed description and the attached drawings and appendices, numerous specific details are set forth to provide a thorough understanding of the present disclosure. However, those skilled in the art will appreciate that the present disclosure may be practiced, in some instances, without such specific details. In other instances, well-known elements have been illustrated in schematic or block diagram form in order not to obscure the present disclosure in unnecessary detail. Additionally, for the most part, specific details, and the like, have been omitted inasmuch as such details are not considered necessary to obtain a complete understanding of the present disclosure, and are considered to be within the understanding of persons of ordinary skill in the relevant art.

With initial reference to FIGS. 1-3 and 6-7, a magazine 100 for use as an ammunition feeding device for an autoloading firearm, such as a Model 1911 semi-automatic pistol, will now be described. Generally speaking, the magazine 100 is comprised of a magazine box 180 having a magazine spring 190 (shown in FIGS. 6-7) therein that urges a follower 150 upwardly toward an open end of the magazine box 180; the follower 150 is biased or canted within the magazine box 180 such that an interference fit is formed between portions of the follower 150 and portions of the magazine box 180, while a non-interference fit is formed between other portions of the follower 150 and other portions of the magazine box 180. This serves to positively locate the follower 150 within the magazine box 180, helping to ensure a consistent location of the follower 150 within the magazine box 180 when the last cartridge in the magazine 100 has been ejected from the firearm, and thus helping to ensure that the follower 150 is properly and securely engaged by the slide stop of the firearm, which causes the slide of the firearm to lock open after the last cartridge has been fired, extracted from the chamber, and ejected from the firearm.

In greater detail, the magazine 100 is comprised of a magazine box 180 defined by a front sidewall 186 and a rear sidewall 188. A first lateral sidewall 182 and a second lateral sidewall 184 respectively extend between corresponding first and second ends of the front sidewall 186 and rear sidewall 188. A lower sidewall 189 (shown in FIG. 6) closes the lower end of the magazine box 180, and the upper end of the magazine box 180 remains open.

A magazine spring 190 (shown in FIGS. 6-7) is disposed within the magazine box 180. A follower 150 is disposed within the magazine box 180, and is retained within by retainers 182*a*, 184*a*, which may be formed from rolled tops of the lateral sidewalls 182, 184 or by other suitable means of reducing the width of the upper end of the magazine box 180.

These retainers 182*a*, 184*a* extend inwardly sufficiently to reduce the width at the upper end of magazine box 180 to a width less than the width of cartridges 200. The retainers 182*a*, 184*a* thus provide surfaces on either lateral side of magazine box 180 against which the uppermost cartridge 200 is urged by magazine spring 190, and prevent the loaded cartridges from being pushed out of the magazine 100 along the longitudinal axis of the magazine 100. The retainers 182*a*, 184*a* are also angled from the front to the rear of magazine box 180 to place the uppermost cartridge 200 at a desired angle to be stripped from the magazine 100 moved into a firing position in the firearm.

Figure 4:
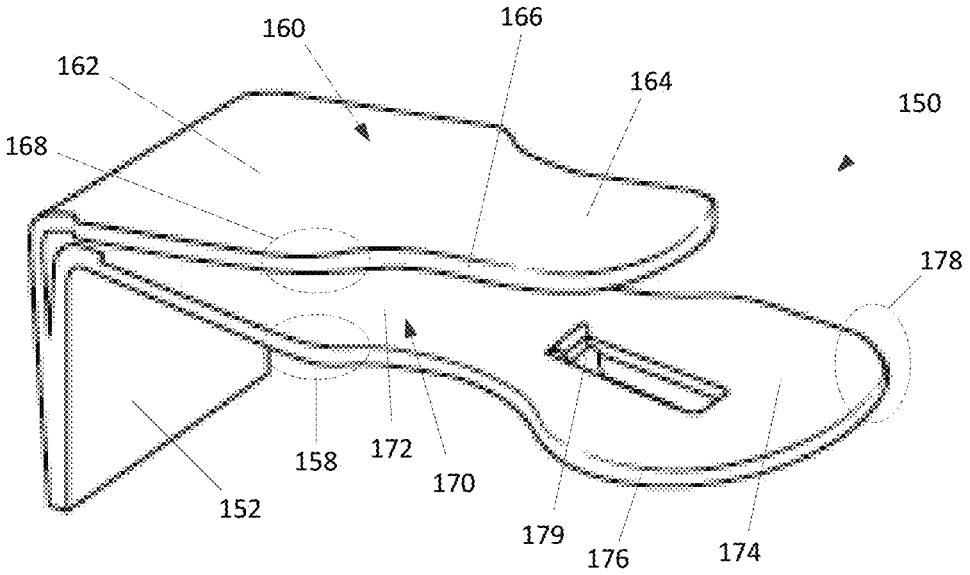
FIG. 4 is a perspective view of the follower of the magazine.
Figure 5:
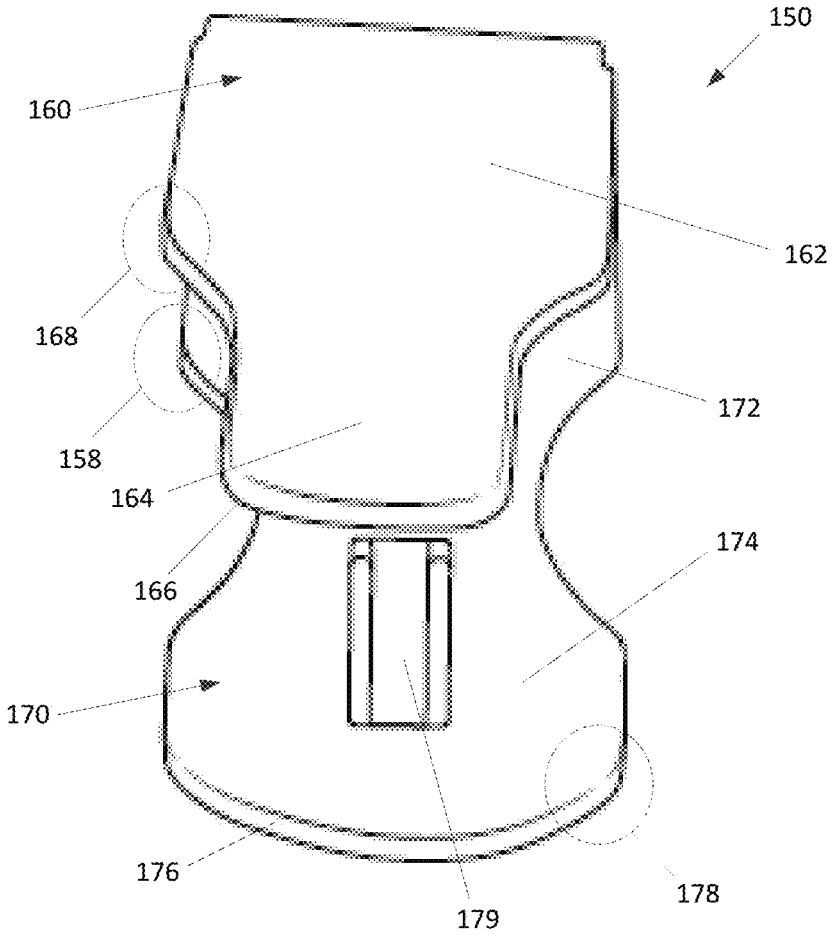
FIG. 5 is a front isometric view of the follower of the magazine.

The follower 150 is urged toward the open end of the magazine box 180 by the magazine spring 190, which is mechanically coupled to the follower 150 via tab 179 (shown in FIGS. 4-5).

Referring additionally to FIGS. 4-5, further details of the follower 150 itself will now be given. The follower 150 is formed from a suitable material, such as steel, and is comprised of a base member 152, with a cartridge engaging structure 160 and a slide stop actuating structure 170 extending outwardly therefrom.

The base member 152 extends along a longitudinal axis of the magazine box 180, while the cartridge engaging structure 160 and slide stop actuating structure 170 extend transversally from the base member 152. In the illustrated embodiment, the base member 152 extends at approximately 90° to the cartridge engaging structure 160 and slide stop actuating structure 170. However, as should be appreciated, other suitable angles may be used and are fully within the scope of the invention. In particular, it may be desirable for the base member 152 to extend at an obtuse angle with respect to the cartridge engaging structure 160 and slide stop actuating structure 170 to help maintain those structures at a desired orientation within the magazine box 180. Indeed, this configuration allows a rear surface of the base member 152 to extend approximately parallel to the rear sidewall 188 of the magazine box 180 as the follower 150 travels along the length of the magazine box 180.

The cartridge engaging structure 160 is located above the slide stop actuating structure 170, and is biased resiliently away from the upper surface of the slide stop actuating structure 170 toward the open end of the magazine box 180. The bias is provided by the resiliency in the material from which the cartridge engaging structure 160 is constructed, particularly toward the location at where the cartridge engaging structure 160 joins the base member 152.

The cartridge engaging structure 160 is comprised of a base portion 162 extending from the base member 152, having a width extending approximately across a width of the magazine box 180 between the lateral sidewalls 182, 184, and having a reduced width distal portion 164 extending from the base portion 162 toward the front sidewall 186.

The slide stop actuating structure 170 is comprised of a base portion 172 extending from the base member 152, having a width extending approximately across a width of the magazine box 180 between the lateral sidewalls 182, 184, and having a distal portion 174 extending from the base portion 172 toward the front sidewall 186. The distal portion 174, as it extends from the base portion 172, has a reduced width transitional curved portion, and then expands back to full width. At the tip of the distal portion 174, the shape thereof is generally semicircular in shape, and is bent so as to be angled upward. This bend has an inclination angle of approximately 15° with respect to the base portion 172, providing for an inclined engagement surface with the slide stop. This inclination angle, however, may range from approximately 5° to 20°, depending on the caliber of the cartridges to be used and the particular firearm in which the magazine 100 is intended to be used. Smaller or steeper angles may also be used in some applications.

Figure 6:
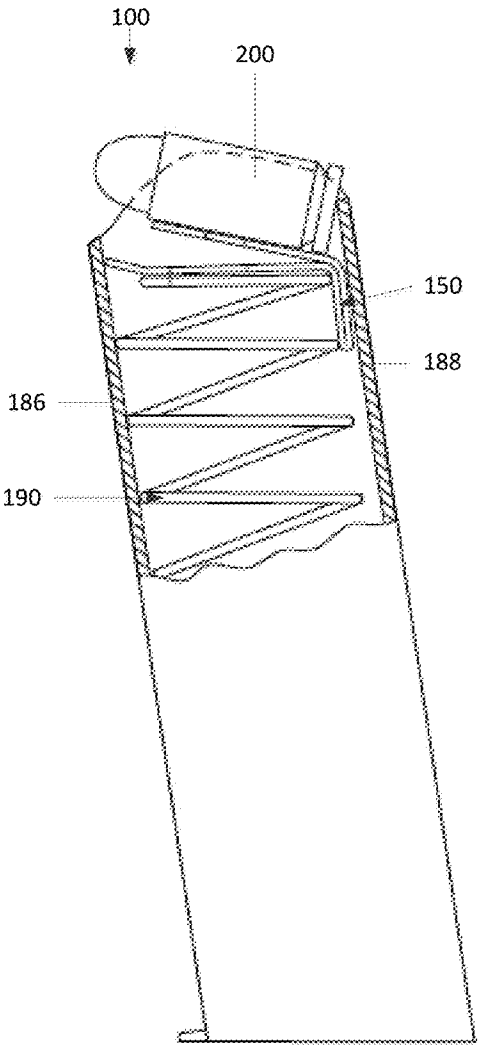
FIG. 6 is a partial cutaway view of the magazine where the spring is partially compressed and the magazine is loaded with a single cartridge.

It should be noted that the length of the cartridge engaging structure 160 is shorter than the length of the slide stop actuating structure 170 so as to prevent the cartridge engaging structure 160 from contacting the upwardly angled portion of the distal portion 174 of the slide stop actuating structure 170 when the cartridge engaging structure 160 and the slide stop actuating structure 170 are compressed together by cartridges, as shown in FIG. 6.

The cartridge engaging structure 160 and slide stop actuating structure 170 are resilient in both an upward and downward direction as well as a lateral direction. In the illustrated embodiment, the cartridge engaging structure 160 and slide stop actuating structure 170 are resiliently biased in a lateral direction away from a longitudinal axis of the base member 152. This biasing permits the cartridge engaging structure 160 and slide stop actuating structure 170 to be movable between a compressed position and a relatively uncompressed position. In the compressed position, longitudinal axes of the cartridge engaging structure 160 and the slide stop actuating structure 170 are laterally perpendicular with respect to the longitudinal axis of the base member 152. Stated another way, in the compressed position, the cartridge engaging structure 160 and slide stop actuating structure 170 have longitudinal axes that extend from the base member 152 to the front sidewall 186 of the magazine box 180, and along the length of that extension are equidistant from the lateral sidewalls 182, 184 of the magazine box 180.

In the relatively uncompressed position, longitudinal axes of the cartridge engaging structure 160 and slide stop actuating structure 170 are not laterally perpendicular with respect to the longitudinal axis of the base member 152. Stated another way, in the relatively uncompressed position, the cartridge engaging structure 160 and slide stop actuating structure 170 have longitudinal axes that extend from the base member 152 to the front sidewall 186 of the magazine box 180, and along the length of that extension are not equidistant from the lateral sidewalls 182, 184 of the magazine box 180.

The cartridge engaging structure 160 and slide stop actuating structure 170 are in the relatively uncompressed position in the magazine box 180, which serves to urge the cartridge engaging structure 160 and slide stop actuating structure 170 into a canted position within the magazine tube 180. This canted position results in an interference fit being formed between some portions of the cartridge engaging structure 160 and slide stop actuating structure 170 and the magazine box 180, and a non-interference fit being formed between some portions of the cartridge engaging structure 160 and slide stop actuating structure 170 and the magazine box 180.

In particular, the following interference fits or contact point are formed: at point 158, the slide stop actuating structure 170 contacts the lateral sidewall 184 of the magazine box 180; at point 168, the cartridge engaging structure 160 contacts the lateral sidewall 184 of the magazine box 180; and at point 178, the slide stop actuating structure 170 contacts the lateral sidewall 182.

The contact point 158 is between a transition between the base portion 172 and the distal portion 174 of the slide stop actuating structure 170 and the lateral sidewall 184. In greater detail, this contact point 158 may be between at least a portion of the sidewall 176 of the slide stop actuating structure 170 and the lateral sidewall 184.

The contact point 168 is between a transition between the base portion 162 and distal portion 164 of the cartridge engaging structure 160 and the lateral sidewall 184. In greater detail, this contact point 168 may be between at least a portion of the sidewall 166 of the cartridge engaging structure 160 and the lateral sidewall 184.

The contact point 178 is between a tip of the distal portion 174 of the slide stop actuating structure 170 and the lateral sidewall 182. In greater detail, this contact point 178 may be between at least a portion of the sidewall 176 of the slide stop actuating structure 170 and the lateral sidewall 182.

It should be appreciated that although three specific contact points 158, 168, and 178 have been described, the follower 150 may be constructed such that the base member 152, the cartridge engagement structure 160, and the slide stop actuating structure 170 may contact the magazine tube 180 at any desired points. Indeed, any number of points, at any location or locations on the base member 152, the cartridge engagement structure 160, and the slide stop actuating structure 170, may contact anywhere on the magazine tube 180.

It should also be appreciated that while the base member 152, cartridge engagement structure 160, and the slide stop actuating structure 170 are each shown as having contact points with the magazine tube 180, that need not be the case, and that in some applications but one of the base member 152, cartridge engagement structure 160, and the slide stop actuating structure 170 may contact the magazine tube 180.

Also, while the base member 152, the cartridge engagement structure 160 and the slide stop actuating structure 170 are described as being biased or canted in a same direction, it should be appreciated that they need not be, and that in some applications the base member 152, the cartridge engagement structure 160, and the slide stop actuating structure 170 may be biased or canted in opposite directions. Moreover, while in some applications the longitudinal axes of the cartridge engagement structure 160 and the slide stop actuating structure 170 may be laterally aligned with one another, in other applications that need not be the case, and the longitudinal axes of the cartridge engagement structure 160 and the slide stop actuating structure 170 may not be laterally aligned with one another. Also, in some applications, one of the base member 152, the cartridge engagement structure 160 and the slide stop actuating structure 170 may unbiased or uncanted, while the other(s) are biased or canted.

The advantages provided by the above described magazine 100 and follower 150 are numerous. One advantage provided is that when the magazine 100 is empty of cartridges, a portion of the slide stop actuating structure 170 protrudes out from the magazine box 180, as perhaps best shown in FIG. 3. This provides for an increased surface are available for engagement with the slide stop of the firearm, thereby ensuring that after the last cartridge is expended, the slide of the firearm locks back.

In addition, as should be understood, manufactured items typically do not have identical dimensions, and are instead manufactured such that their dimensions fit within a set of tolerances. The way in which the cartridge engagement structure 160 and the slide stop actuating structure 170 are biased such that portions thereof are urged into an interference fit with the magazine tube 180 provides a self adjustment mechanism, adjusting the fit to match the specific dimensions and tolerance of a given magazine tube 180, providing for consistent function and performance between different manufactured units.

A zero tolerance fit between all peripheral surfaces of the follower 150 and the magazine box 180 is seldom desirable and/or seldom practical in the event of a build up of power fouling within the magazine box 180, or if foreign debris enters the inside of the magazine box 180. The follower 250 described herein possesses the advantages provided by a zero tolerance fit, yet not the disadvantages thereof by having both interference and non-interference fit points with the magazine box 180.

Controlling and biasing one or more of the contact points 158, 168, and 178 not only continues to allow free/smooth movement of the follower 150 within the magazine box 180, but also allows one or more of the contact points 158, 168, and 178 to be biased into locations which yield improved reliability of function where interface of the follower 150 occurs with other pistol components such as the slide stop.

It should be appreciated that these contact points 158, 168, and 178, or any contact points, can be facilitated, tuned, and adjusted with various shapes such as flat surfaces, radiused/rounded lobes, single sharp tips, concaves, convex, etc.

The follower 150 may be integrally formed as a monolithic unit. That is, the follower may be formed from a single piece of material, such as spring steel that is trimmed and bent into the proper shape. Other methods of construction of the follower 150 are intended to be within the scope of this disclosure.

FIG. 6 shows the condition of magazine 100 in which one cartridge 200 is held in the magazine 100. This condition occurs after one cartridge 200 is loaded into magazine 100 and in operation of the firearm when one cartridge remains after the others have been stripped from the magazine. In this position, the cartridge engaging structure 160 has decompressed somewhat toward its extended position so as to, along with the remaining spring force applied from the partially decompressed magazine spring 190, urge the lone cartridge 200 into the desired inclined position against retainers 182*a*, 184*a*. It should also be noted from FIG. 6 that tip of the distal end 174 of the slide lock engaging structure 170 remains within the enclosure provided by magazine box 180 when one cartridge 200 is loaded in the magazine 100.

Figure 7:
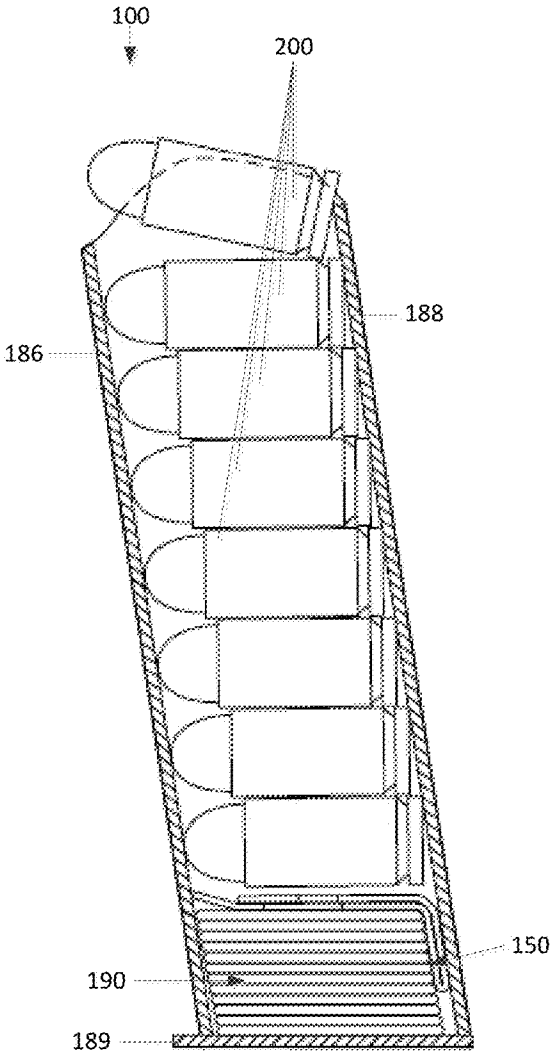
FIG. 7 is a cutaway view of the magazine where the spring is fully compressed and the magazine is loaded with a full complement of cartridges.

Referring particularly to FIG. 7, when the magazine 100 is fully loaded with cartridges 200, the magazine spring 190 is fully compressed below the follower 150. The cartridge engaging structure 160 is also fully compressed so as to lie generally against the upper surface the slide stop actuating structure 170. Both the spring force of magazine spring 190 and the cartridge engaging structure 160 force the column of cartridges 200 upwardly in the magazine 100 toward the top of the magazine. The magazine spring 190 may be reduced in strength in view of the spring action provided by cartridge engaging structure 160. This reduction in the strength of magazine spring 190 allows the magazine spring 190 to be made of smaller diameter material which allows the spring 190 to compress to a smaller volume in magazine box 180. This smaller volume required for the compressed magazine spring 190 allows at least one additional cartridge 200 to be loaded into the magazine 100 as compared to the same sized magazine without this advanced new follower 150 design.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

The invention claimed is:

1. A magazine follower for a firearm comprising:

a base member;

a slide stop actuating structure extending outwardly from the base member;

a cartridge engaging structure extending outwardly from the base member;

wherein at least one of the slide stop actuating structure and the cartridge engaging structure are resiliently biased in a lateral direction away from a longitudinal axis of the base member so as to be movable between:

a compressed position wherein a longitudinal axis of at least one of the slide stop actuating structure and the cartridge engaging structure is laterally perpendicular with respect to the longitudinal axis of the base member, and an uncompressed position where the longitudinal axis of at least one of the slide stop actuating structure and the cartridge engaging structure is not laterally perpendicular with respect to the longitudinal axis of the base member.

2. The magazine follower of claim 1, wherein the slide stop actuating structure and the cartridge engaging structure are both resiliently biased in a lateral direction away from a longitudinal axis of the base member.

3. The magazine follower of claim 2, wherein the slide stop actuating structure and the cartridge engaging structure are both resiliently biased in a same lateral direction away from a longitudinal axis of the base member.

4. The magazine follower of claim 1, wherein the slide stop actuating structure is resiliently biased in a lateral direction away from a longitudinal axis of the base member.

5. The magazine follower of claim 1, wherein the cartridge engaging structure is resiliently biased in a lateral direction away from a longitudinal axis of the base member.

6. The magazine follower of claim 1, wherein, when in the uncompressed position, the longitudinal axis of the slide stop actuating structure is not laterally aligned with the longitudinal axis of the cartridge engaging structure.

7. The magazine follower of claim 1, wherein, when in the compressed position, the longitudinal axis of the slide stop actuating structure is laterally aligned with the longitudinal axis of the cartridge engaging structure.

8. The magazine follower of claim 1, wherein the base member, slide stop actuating structure, and cartridge engaging structure are integrally formed.

9. The magazine follower of claim 1, wherein the base member, slide stop actuating structure, and cartridge engaging structure are integrally formed from a metallic sub stance.

10. The magazine follower of claim 1, wherein the slide stop actuating structure has a distal end portion extending upwardly from a longitudinal axis of the slide stop actuating structure so as to provide an inclined slide stop actuating surface.

11. A magazine for a firearm comprising:

a magazine box;

a magazine spring within the magazine box;

a magazine follower within the magazine tube and being urged toward an open end of the magazine box by the magazine spring;

wherein the magazine follower comprises:

a base member extending along a longitudinal axis of the magazine box; a slide stop actuating structure extending outwardly from the base member;

a cartridge engaging structure extending outwardly from the base member;

wherein at least one of the slide stop actuating structure and the cartridge engaging structure are resiliently biased in a lateral direction away from a longitudinal axis of the base member so as to be movable between:

a compressed position wherein a longitudinal axis of at least one of the slide stop actuating structure and the cartridge engaging structure is laterally perpendicular with respect to the longitudinal axis of the base member, and an uncompressed position where the longitudinal axis of at least one of the slide stop actuating structure and the cartridge engaging structure is not laterally perpendicular with respect to the longitudinal axis of the base member.

12. The magazine of claim 11, wherein, when in the uncompressed position, an interference fit is formed between the magazine box and at least one portion off the magazine follower.

13. The magazine of claim 11, wherein, when in the uncompressed position, an interference fit is formed between the magazine box and at least one portion of the magazine follower, and a non-interference fit is formed between the magazine box and at least one other portion of the magazine follower.

14. The magazine of claim 11, wherein the magazine box has a lower wall, front sidewall, rear sidewall, and first and second lateral sidewalls respectively extending between the front sidewall and rear sidewall at opposite sides thereof to define the open end; wherein the cartridge engaging structure has an upper surface facing the open end of the magazine box, a lower surface facing the lower wall of the magazine box, and a lateral wall; and wherein, when in the uncompressed position, an interference fit is formed between at least one portion of the lateral wall of the cartridge engaging structure and one of the first and second lateral sidewalls of the magazine box.

15. The magazine of claim 14, wherein the interference fit is formed between a first portion of the lateral wall of the cartridge engaging structure and the first lateral sidewall of the magazine box.

16. The magazine of claim 11, wherein the magazine box has a lower wall, front sidewall, rear sidewall, and first and second lateral sidewalls respectively extending between the front sidewall and rear sidewall at opposite sides thereof to define the open end; wherein the slide stop actuating structure has an upper surface facing the open end of the magazine box, a lower surface facing the lower wall of the magazine box, and a lateral wall; and wherein, when in the uncompressed position, an interference fit is formed between at least one portion of the lateral wall of the slide stop actuating structure and one of the first and second lateral sidewalls of the magazine box.

17. The magazine of claim 16, wherein the interference fit is formed between a first portion of the lateral wall of the slide stop actuating structure and the first lateral sidewall of the magazine box.

18. The magazine of claim 11, wherein the magazine box has a lower wall, front sidewall, rear sidewall, and first and second lateral sidewalls respectively extending between the front sidewall and rear sidewall at opposite sides thereof to define the open end; wherein the slide stop actuating structure has an upper surface facing the open end of the magazine box, a lower surface facing the lower wall of the magazine box, and a lateral wall; wherein one of the front and second lateral sidewalls and the front sidewall are shaped such that a portion of the lateral wall of the slide stop actuating structure, when in the uncompressed position, is permitted to protrude outwardly beyond the front or second lateral sidewall of the magazine box.

19. The magazine of claim 11, wherein the magazine box has a lower wall, front sidewall, rear sidewall, and first and second lateral sidewalls respectively extending between the front sidewall and rear sidewall at opposite sides thereof to define the open end; wherein the slide stop actuating structure has an upper surface facing the open end of the magazine box, a lower surface facing the lower wall of the magazine box, and a lateral wall; and wherein, when in the uncompressed position, an interference fit is formed between at least one portion of the lateral wall of the slide stop actuating structure and one of the first and second lateral sidewalls of the magazine box; wherein the cartridge engaging structure has an upper surface facing the open end of the magazine box, a lower surface facing the lower wall of the magazine box, and a lateral wall; and wherein, when in the uncompressed position, an interference fit is formed between at least one portion of the lateral wall of the cartridge engaging structure and one of the first and second lateral sidewalls of the magazine box.

* * * * *